US005777436A

United States Patent [19]

Lepselter

[11] Patent Number: 5,777,436

[45] Date of Patent: Jul. 7, 1998

[54] GAS DISCHARGE FLAT-PANEL DISPLAY AND METHOD FOR MAKING THE SAME

[75] Inventor: Martin P. Lepselter, Summit, N.J.

[73] Assignee: Spectron Corporation of America, L.L.C., Summit, N.J.

[21] Appl. No.: 564,047

[22] PCT Filed: May 25, 1994

[86] PCT No.: PCT/US94/06092

§ 371 Date: Mar. 11, 1996

§ 102(e) Date: Mar. 11, 1996

[87] PCT Pub. No.: WO94/28570

PCT Pub. Date: Dec. 8, 1994

[51] Int. Cl.[6] ..... H01J 17/20

[52] U.S. Cl. ..... 313/582; 313/572; 313/637

[58] Field of Search ..... 313/582, 484, 313/521, 572, 574, 568, 637; 345/41, 60, 63; 315/169.4

[56] References Cited

U.S. PATENT DOCUMENTS 5,469,021 11/1995 Lepselter ..... 313/582

*Primary Examiner*—Sandra L. O'Shea
*Assistant Examiner*—Vip Patel
*Attorney, Agent, or Firm*—Darby & Darby

[57] ABSTRACT

A flat-panel gas discharge display operable with either alternating or direct current is free of implosive forces because it operates at least at substantially atmospheric pressure. The display comprises a first set of conductors disposed on a transparent substrate and a second set crossing over the first set at a distance therefrom. An array of crosspoints is formed at each location where a conductor of the second set crosses over a conductor of the first set. A gas is contained in the space between the first and second sets of conductors at each crosspoint. The gas will undergo light emissive discharge when a voltage greater than or equal to the Paschen minimum firing voltage is applied at a crosspoint. Air may be used as the operative gas. The display is formed on a single substrate, and may be stacked with additional displays in lieu of one or more capping layers. At least one of the sets of conductors may be provided with an aperture at each of the crosspoints to facilitate viewing the discharge. A system incorporating the flat-panel display is presented. A suitably wired flat-panel structure may constitute a flat-panel plasma discharge lamp for lighting applications.

22 Claims, 5 Drawing Sheets

FIG. 4
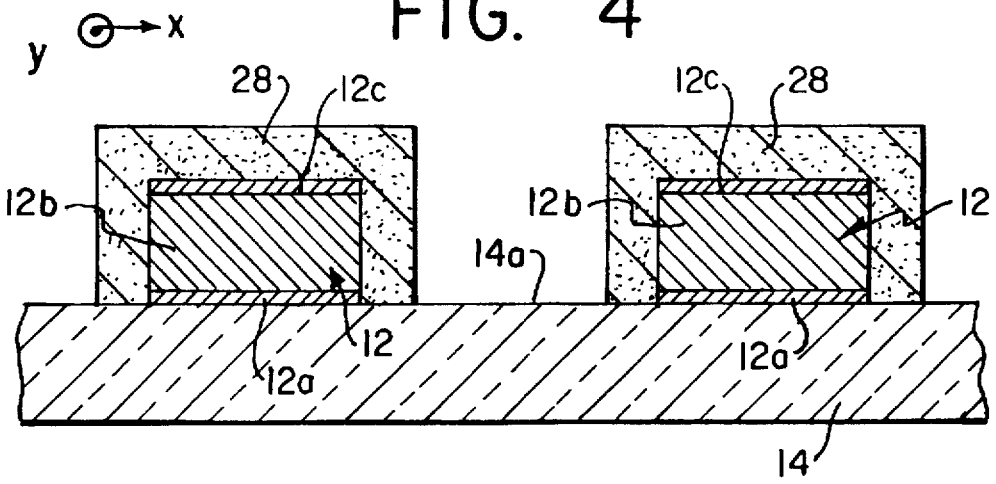
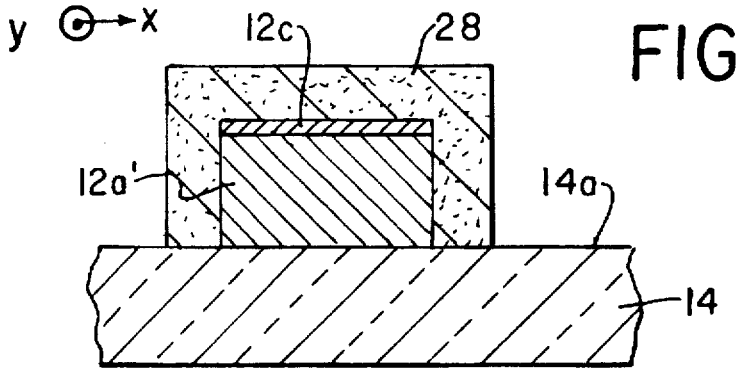
FIG. 4a
FIG. 5
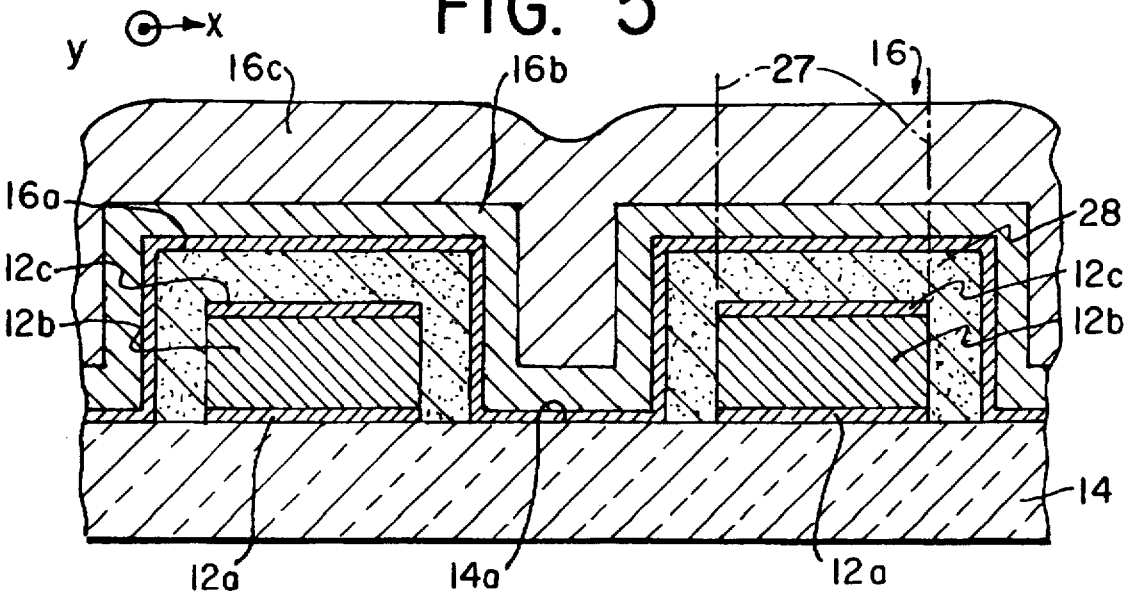

GAS DISCHARGE FLAT-PANEL DISPLAY AND METHOD FOR MAKING THE SAME

BACKGROUND OF THE INVENTION

This invention relates to a flat-panel display structure and a method for making the same and, in particular, to a gas discharge display formed on a single side of a substrate operable with gases at least at substantially atmospheric pressure.

Plasma based flat-panel displays have been known since the late 1960's. Broadly, such displays enclose a gas or mixture of gases in a partial vacuum sealed between opposed and crossed ribbons of conductors. The crossed conductors define a matrix of crossover points which are essentially an array of miniature neon picture elements ("pixels") or lamps that provide their own light. At any given pixel, the crossed, spaced conductors act like opposed electrode plates of a capacitor. At each intersection point, a sufficiently large applied voltage causes the gas to break down locally into a plasma of electrons and ions and glow as it is excited by current. Paschen's Law relates the voltage at which a gas breaks down into a plasma, the so called spark or firing voltage, to the product of the pressure of the gas, p (in mm Hg), times the distance, d (in cm), between the electrodes. By scanning the conductors sequentially, a row at a time, with a voltage sufficient to cause the pixels to glow, and repeating the process at least sixty times per second, a steady image can be perceived by the human eye.

These displays have heretofore required that a partial vacuum be established in order to bring the pressure-distance product closer to the region of the so called Paschen minimum firing voltage. The low pressure ambient employed in prior art designs ensured a longer mean free path for liberated electrons by lowering the density of gas molecules in the region between the conductors. The low pressure ambient facilitated higher current levels because the liberated electrons could travel faster toward other gas molecules and hit them harder to free additional electrons. See S. C. Miller, Neon Techniques and Handling, p. 11 (3 *d* Ed. 1977). However, in order to ensure a uniform firing voltage across the panel of these conventional designs, the conductors must be precisely spaced and registered within the vacuum envelope.

The need to establish a partial vacuum has created other manufacturing complexities which have increased the cost of producing flat-panel gas discharge displays. The pressure imbalance between the internal vacuum environment and the external atmosphere has necessitated manufacturing flat-panel displays from reinforced materials so as to withstand the implosive pressure (fifteen pounds per square inch) exerted across the display surface of the panels. Also, rare gases are used for the plasma material which require sophisticated manufacturing facilities. These problems have inspired much of the more recent efforts in the field to look to display structures of other designs including liquid crystals and electroluminescent polymers. See Depp and Howard, Flat-Panel Displays, Scientific American (March 1993) p.90.

In addition, conventional plasma displays suffer from low brightness and difficulties in extending their resolution to a level required for workstation displays because the mechanical structures required to retain the plasma may not readily be fabricated in the required geometry.

Accordingly, it would be advantageous to manufacture a gas discharge flat-panel display operable at least at substantially atmospheric pressure using air as the operative gas.

SUMMARY OF THE INVENTION

An object of this invention is to provide a flat-panel display formed on a single substrate using airbridge technology.

Also, an object of this invention is to provide a flat-panel display operable at substantially atmospheric pressure.

An additional object is to provide a flat-panel display that induces light emissive discharge in a gas at or near the gas's Paschen minimum firing voltage.

Another object is to provide a gas discharge flat-panel display not subject to implosive forces.

Yet another object is to provide a gas discharge flat-panel display mounted on a flexible substrate capable of being rolled like a map.

Still another object is to provide a flat-panel plasma lamp for general or back-lighting applications.

The present invention provides a flat-panel gas discharge display operable with either alternating or direct current that is free of implosive forces because it operates at least at substantially atmospheric pressure. The display comprises a first set of conductors disposed on a transparent substrate and a second set which cross over the first set at a distance therefrom. An array of crosspoints is formed at each location where a conductor of the second set crosses over a conductor of the first set. A gas is contained in the space between the sets of conductors at each crosspoint. This gas will undergo light emissive discharge when a Paschen minimum firing voltage is applied across the space at that crosspoint. An important feature of the present invention is that air may be used as the operative gas which minimizes the cost and complexity of manufacture. Longevity of the panel is preserved by selecting the cathode material from among known non-sputterable conductors. In a preferred embodiment, the display is formed on a single side of a substrate. Also in a preferred embodiment, at least one of the sets of conductors may be provided with an aperture at each of the crosspoints to facilitate viewing the discharge.

These and other objects, features and advantages of the present invention will be readily apparent from the following detailed description of certain preferred embodiments taken in conjunction with the accompanying unscaled drawings, in which.

Figure 2:
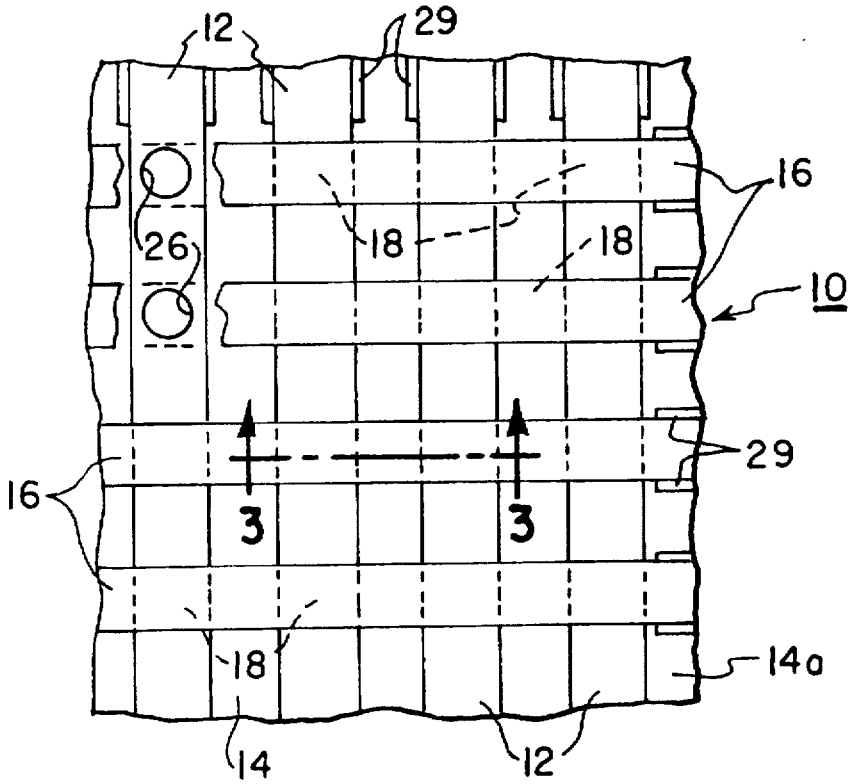
FIG. 2 is a top elevational view of a portion of a flat-panel display constructed according to one embodiment of the present invention.
Figure 3:
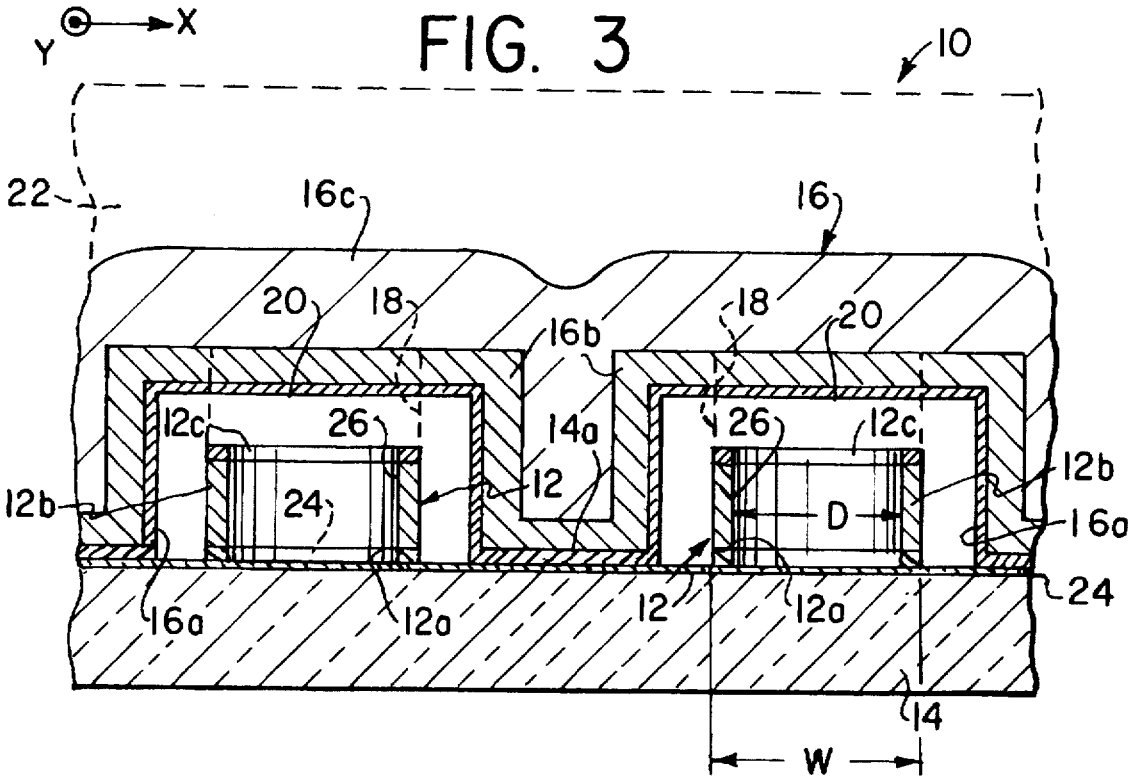
FIG. 3 is a cross-sectional view along line 3—3 of FIG. 2.
Figure 3A:
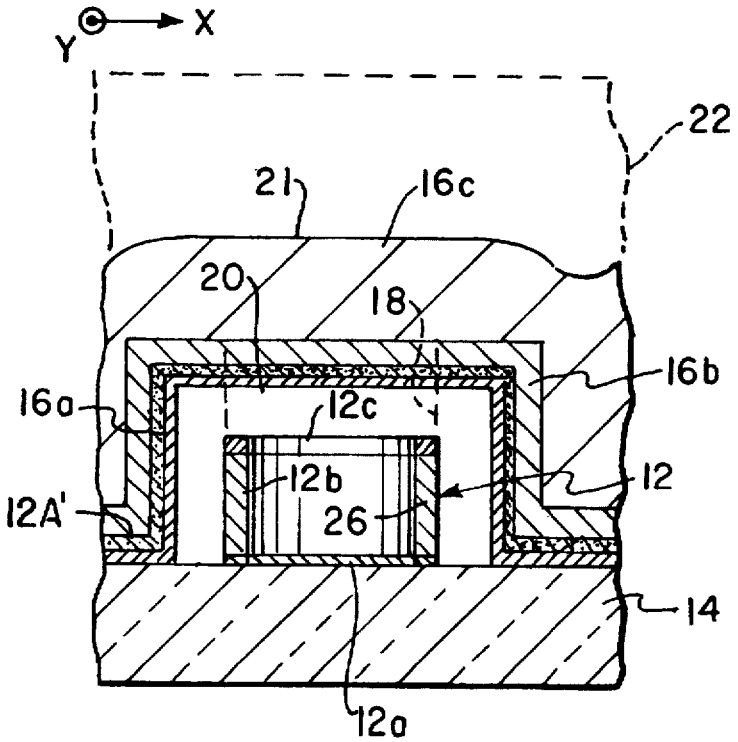
Figure 6:
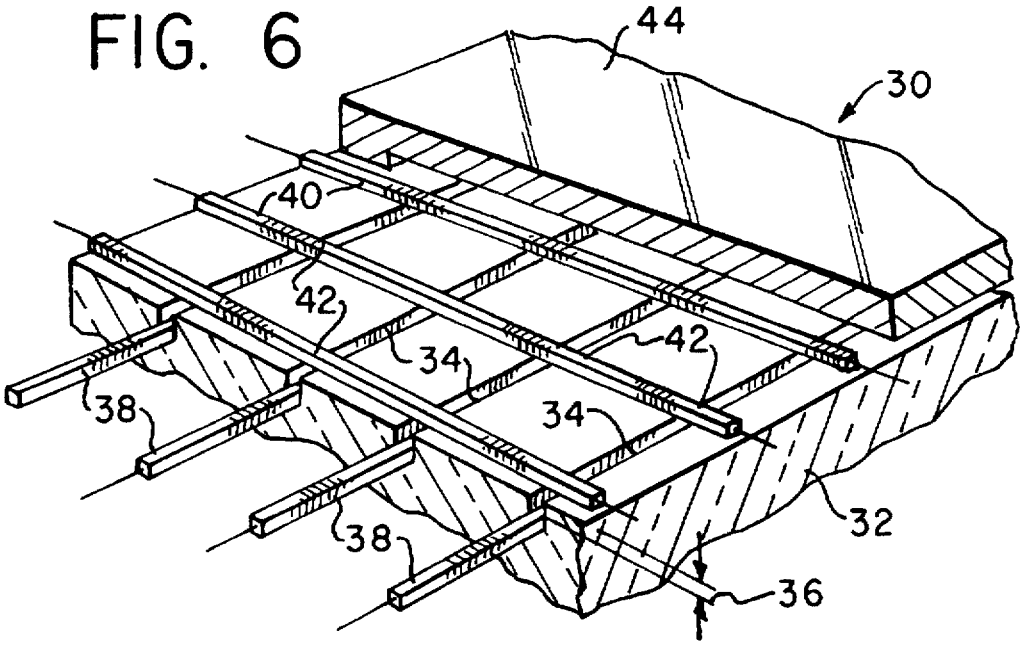
Figure 7:
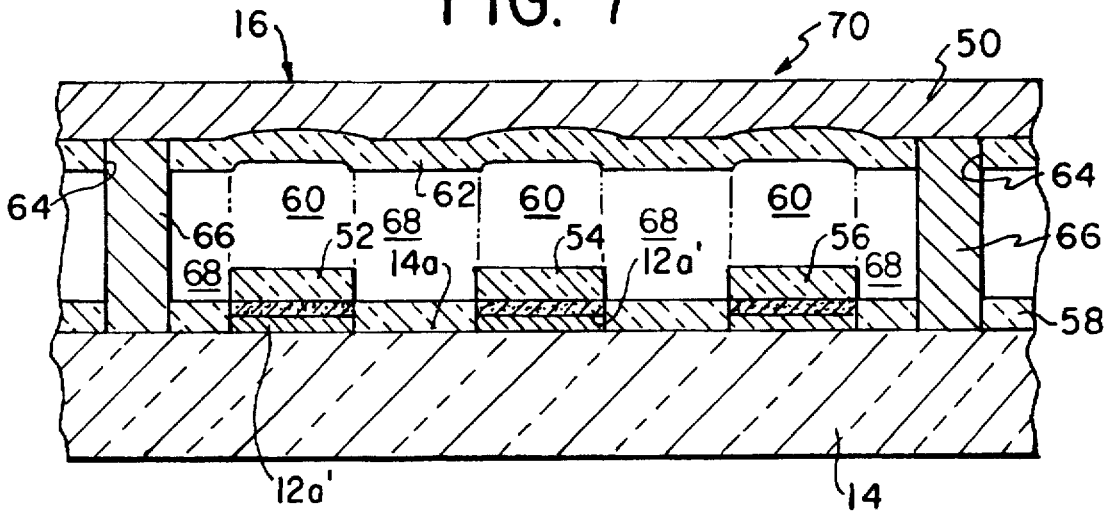
Figure 8:
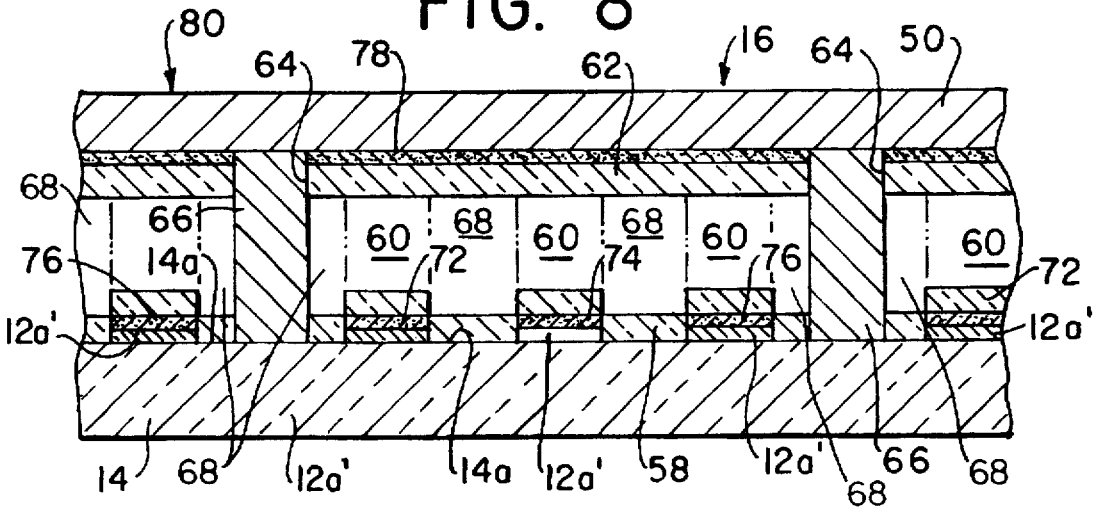
Figure 9:
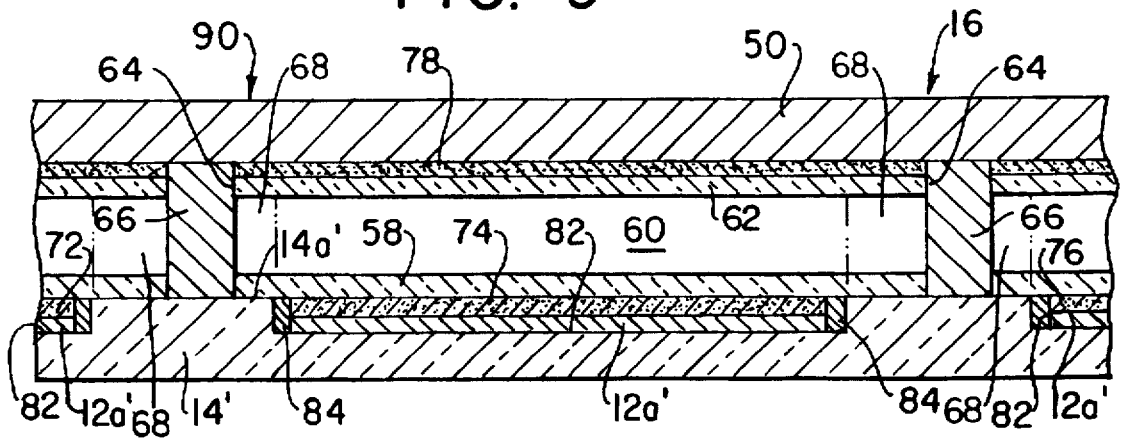

FIG. 3*a* is a partial view of FIG. 3 showing a modification of the embodiment of FIG. 2;

FIG. 4 is a cross-sectional view of a portion of a flat-panel display device being formed according to the embodiment of FIG. 2;

FIG. 4*a* is a partial cross-sectional view of an alternate construction of the flat-panel display device of FIG. 4;

FIG. 5 is the structure of FIG. 4 at a later stage of processing;

FIG. 6 is a perspective view of a portion of a flat-panel display device constructed in accordance with a second embodiment of the present invention;

FIG. 7 is a cross-sectional view of a portion of a third embodiment of the flat-panel display device according to the invention;

FIG. 8 is a cross-sectional view of a portion of a fourth embodiment of the flat-panel display device according to the invention; and FIG. 9 is a modification of the embodiment of FIG. 8 showing metallized sidewalls for high-speed operation.

Figure 10:
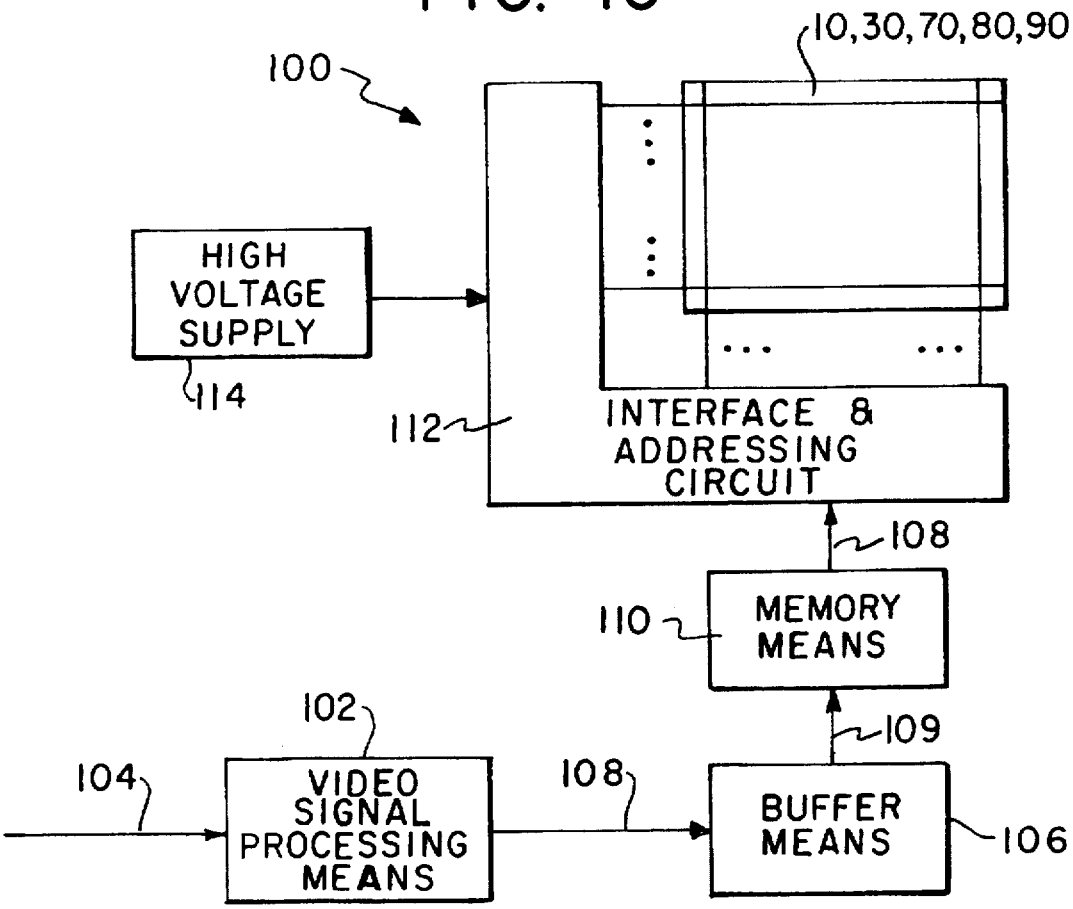

FIG. 10 is a block diagram of a video display system incorporating the flat-panel display of the present invention.

DETAILED DESCRIPTION OF THE PREFERRED EMBODIMENTS

In accordance with Paschen's Law, every gas has a characteristic minimum firing voltage Vmin (see FIG. 1) associated with a particular pressure-distance ("pd") product. The firing voltage rises above this minimum at all other values of the pd product. In the region below curve A, B or C, a gas will not spark and there will be no initial discharge; however, an existing discharge can be sustained with voltages in this region. It is generally desirable to design a gas discharge display to operate at or near the Paschen minimum firing voltage in order to facilitate interconnection with microelectronic control circuitry.

By way of overview and introduction, there is seen in FIGS. 2 and 3 a portion of a flat-panel display 10 formed in accordance with one embodiment of the present invention. The fabricated structure 10 comprises a set of conductors 12 disposed in y-directed columns on an insulating substrate 14 and a second set of conductors 16 disposed in x-directed rows which cross over the first set to form a regular array of crosspoints 18. Substrate 14 may be a flexible material having a substantially planar surface for forming conductors thereon for applications where a flexibly rollable display is desired, for example, a map. A gas contained in at least a space 20 defined by each of these crosspoints 18 is broken down into a plasma upon application of a suitable voltage in accordance with Paschen's law, described above. According to the invention, crosspoints 18 separate conductors 12,16 with a preselected and uniform distance so that the same voltage signal can induce glow discharge at any of the crosspoints. This is advantageously accomplished with the airbridges described herein which are preferably formed by etching a sacrificial layer from between conductors 12,16. The sacrificial layer provides local thickness control at each crosspoint 18 of the entire array of crosspoints which comprise the display.

As a departure from the prior art, the flat-panel display of the present invention utilizes an airbridge structure (see, e.g., FIGS. 3, 3*a*, 6–9) to position the crossing conductors in a controllably spaced relationship to one another upon a single substrate. By use of a sacrificial layer 28 which can be etched by means which minimally effect conductive layers 12 and 16, a gasbridge or airbridge may be formed therebetween. The airbridge can space the crossing conductors in the micron range thereby allowing gas pressure levels to be used in the display panel that were heretofore unknown, for example, atmospheric pressure. The type of gas which is contained in space 20 and the spacing of the conductors impact the pressure of the gas when the panel is sealed. By providing local control of the spacing between the conductors 12,16, the sacrificial layer advantageously enables large display panels to be formed when compared to the liquid crystal type panels which dominate the commercial market today. Panels that are ten feet on the diagonal may be fabricated with the same precision as a one foot diagonal screen due to the sacrificial layer.

The airbridge of the panel of the present invention may contain air or any other gas in the space 20. Because the space 20 would typically have a thickness of at least a few microns, the space may be filled with a slurry of electroluminescent particles and alcohol to provide a display panel which causes the electroluminescent material to radiate when the crossing conductors are energized. As understood by those skilled in the art, capillary action is facilitated where the conductors 12,16 or coatings thereon are hydrophilic. Unless treated otherwise, all glasses, such as MgO and $ZrO_2$ are hydrophilic. Alternatively, the space 20 may be filled with a liquid crystal material to provide a uniform liquid crystal display panel structure.

For ease of illustration and as a preferred configuration, conductors 12 and 16 are shown as linear ribbons of conductive material, although other configurations are possible. This topology advantageously enables external circuitry to address each crosspoint 18 by its row and column address in a conventional manner. It is convenient for purposes of discussion only, to assume that conductors 12 are externally configured by electronic circuitry to serve as cathodes and conductors 16 to serve as anodes. The cathode material is advantageously chosen to be a conductive material generally impervious to sputtering, and is preferably zirconium and more preferably tin oxide and its derivatives, such as indium tin oxide (ITO). Derivatives of tin oxide, as used herein, are meant to embrace at least the family of ternary compounds which include an element plus tin and oxygen, as well as compounds containing more than three elements. The virtue of tin oxide and some of its derivatives is that they are transparent. The anode material is also made of conductive material and is preferably nonoxidizable, such as nickel. Preferably, conductors 12 are approximately 1.2 microns thick and conductors 16 are at least eleven microns thick, as viewed in a direction normal to surface 14*a*. Conductors 16 have a substantially thicker profile to impart dimensional stability and to be self-supporting, will become apparent in the discussion of the method of making the display 10. Conductors 12 and 16 preferably comprise stacked layers of conductive material to facilitate the manufacture and longevity of the display 10.

In accordance with the broad object of this invention, a gas may be contained at substantially atmospheric pressure yet may still be broken down into a plasma at or near its Paschen minimum firing voltage because the space 20 between conductors 12 and 16 is precisely dimensioned in the micron range. The plasma resulting from the gas breakdown emits a visible or ultraviolet discharge at a particular crosspoint 18 which, in conjunction with appropriate support circuitry and the other crosspoints 18, constitutes a video display. By video display, it is meant a display for presenting still images, moving images, or sequential images as may be transmitted, broadcast, cablecast, retrieved from a digital or analog store, or computer generated, by means now known or later developed. Alternatively, a conventional switch can be used to power on or off all of the crosspoints 18 simultaneously (or otherwise) for applications where a flat-panel plasma lamp is desired, such as for back-lighting a liquid crystal display. Display 10 may be backed by a capping layer 22 mounted on surface 14*a* to seal out moisture and foreign particles. When the contained gas is at substantially atmospheric pressure, there is an equilibrium of pressure inside and outside of the capped panel. To increase the brightness of the display and shift ultraviolet radiation into the visible spectrum, a layer phosphorescent material may be deposited on substrate 14 (FIG. 3), on one of the conductors (FIGS. 3*a*, 7, 8 and 9).

The density of the picture elements achievable on display 10 is comparable to the line density of a High Definition Television (HDTV) display. The resolution of display 10 is directly related to the width of conductors 12 in the x-direction and the width of the conductors 16 in the y-direction. This is because wider conductors 12, 16 will decrease the overall number of crosspoints 18 per unit area. However, because current flow is proportional to the area of a crosspoint, a brighter image can be obtained by forming wider conductors. Thus, an engineer must strike a balance between resolution and brightness in accordance with application design criteria. For example, to achieve 1250 horizontal lines of resolution, as in an HDTV, a center-to-center conductor spacing of approximately 20 microns per inch of screen is required. This, of course, imposes an upper limit on the cross-sectional area and brightness of crosspoints 18. Therefore, although a 16×9 inch screen would require a 180 micron center-to-center spacing at this level of resolution, an engineer may elect to reduce the width of conductors 12 and 16 (while maintaining the requisite center-to-center spacing) to facilitate viewing of radiation from crosspoints 18 by exposing more of substrate 14 through which the radiation is seen. Thus, for example, conductors 12 and 16 may be advantageously formed 70 microns wide to leave 110 microns of exposed substrate through which radiation from crosspoints 18 may be viewed. This conductor width corresponds roughly to that of a single human hair and would be barely visible.

Referring now to the cross-sectional view in FIG. 3, a series of holes 26 are shown etched through conductors 12, to expose surface 14*a* of substrate 14. Preferably, holes 26 have a diameter slightly smaller than the width of conductors 12. Light discharged at each of the crosspoints 18 of display 10 can be viewed directly through the holes 26, which increases the overall brightness of the image by creating a linear path to view the discharge in front of the reflective backing surface of conductors 16. The resulting "hollow" tube-like cathode structure affords several additional advantages. The hollow cathode structure is more efficient for sourcing electrons than a plate-like cathode because the walls of holes 26 accumulate a negative charge when a crosspoint 18 is initially fired so that subsequent firing of that cathode-anode pair may occur at a lower voltage; a result of the storage of wall potential which imparts a brief "memory" effect. Therefore, by employing a micro-hollow cathode as one electrode and a plate-like structure as the other, an asymmetry of firing voltage results as compared to adjoining pixels not recently fired. Additionally, the accumulated negative charge repels other electrons away from the walls of holes 26 which results in a denser, higher pressure plasma within the center of the hollow cathode which permits excitation of electrons at lower voltages.

The display 10 is operable using either direct or alternating current; however, alternating current is a preferred mode of operation because it results in a brighter image. This is because a crosspoint 18 which has just previously been fired will briefly retain charge at the insulating layers of the electrodes of that crosspoint. This retained charge combines with any subsequent applied voltage, like a memory cell, to sustain or trigger further discharge at a lower applied voltage. In addition, light is emitted a larger portion of the scan time because a pixel can be fired each time the voltage reverses. Conductors 12 and 16 have insulating layers 12*c*, 16*a* on their facing surfaces to capacitively couple the conductors for a.c. operation. The provision of at least one insulating layer precludes a discharge path between the conductors for arcing or sputtering of the conductor-electrodes. This is especially true for a.c. operation with a pulsed excitation source. For d.c. operation, a simpler structure may be formed without insulating layers 12*c*, 16*a* encroaching on space 20.

As understood by those skilled in the art, the voltage applied to conductors 12 and 16 in the a.c. case is not quite the same as the voltage in space 20, the gas discharge region. The display panel structure for a.c. operation includes insulating layers 12*c*, 16*a* on either side of space 20 which can be modeled as thin capacitors (approx. 2000 angstroms) in series with a relatively thick capacitor interposed therebetween (approx. 13 microns). Apart from differing dielectric constants, these thin insulating layers have significantly greater capacitance and hence a significantly smaller voltage drop across them. Accordingly, for an a.c. panel structure which includes insulating layers 12*c*, 16*a*, a voltage slightly greater than a Paschen minimum voltage may have to be applied to the conductors in order to initiate gas discharge at a crosspoint 18 of panel 10. For a d.c. panel structure which lacks these insulating layers, gas discharge can be initiated at or near the Paschen minimum voltage.

FIGS. 6, 7, 8 and 9 illustrate other constructions of the present invention. Each of these constructions illustrates a flat-panel design according to the invention, that is, a flat-panel display formed on a single substrate to provide a plasma display when a voltage in the vicinity of the Paschen minimum voltage for the operative gas is applied. By operative gas, it is meant the particular gas contained in spaces 20. These embodiments differ in other respects from the embodiment illustrated in FIGS. 2 and 3 insofar as particular details of their construction are concerned, which details are exemplary, but not limiting, of various modifications and embellishments to the foregoing inventive concept. However, while these details may provide certain advantages which may make one embodiment more preferable for a particular application, a detailed description of these modifications, adequate to allow those of ordinary skill in the art to make and use the foregoing inventive concepts with these modifications, is provided in connection with the method described below.

The method of making the flat screen display 10 of the present invention will now be described.

FIG. 4 shows, in cross-section, a first set of conductors 12 upon the surface 14*a* of substrate 14. Substrate 14 is preferably made of an insulating material and is transparent for viewing the video image therethrough. Substrate 14 is advantageously made of glass or high-temperature plastic and may be a flexible material having a substantially planar surface for forming conductors thereon. The first set of conductors 12 may be formed by depositing conductive material over substantially all of surface 14*a*, followed by the steps of masking and etching the material to form the conductors 12, as is conventional in the art of thin film manufacturing.

In a preferred embodiment, conductors 12 comprise several layers of material. A first layer 12*a* is deposited on surface 14*a* to ensure bonding to substrate 14. Preferably, this layer is a sheet of zirconium approximately 2500 angstroms thick. This layer is followed by the deposition of a second, nonoxidizing layer 12*b* that provides a solderable or electroformable base for further processing. Platinum is a suitable nonoxidizing material to be used as a second layer because it provides a base for soldering or electroforming additional layers; however, nickel is a preferred, less costly alternative which exhibits similar properties. This second layer 12*b* should be approximately one micron thick.

Alternatively, layers 12*a* and 12*b* may be formed as a single layer 12*a*" (FIG. 4*a*) with the subsequent steps of forming display 10 being substantially the same as for FIG. 4. One preferred material for layer 12*a*" is indium tin oxide because of its known transparency in both the visible and ultraviolet spectrums. This is advantageous for viewing the plasma discharge through conductor 12 itself. A suitable transparent substrate having a conductive layer of tin oxide deposited thereon is available from Libby-Owens Ford, of Toledo, Ohio, under the product name TEC-glass.

For a.c. operation, conductors 12 may be insulated from and capacitively coupled to an opposing second set of conductors 16, discussed below, which will be deposited so as to cross and overlie conductors 12, by depositing an insulating sheet as an uppermost layer 12*c*to the underlying conductive material. These layers also protect the conductors from plasma etching. Preferably, a metal sheet such as zirconium is deposited as layer 12*c*and the zirconium is later oxidized, as discussed below, to form a 2000 angstrom thick insulating layer. For d.c. operation, layer 12*c* would be deposited in the same manner; however, it would not be oxidized but rather would remain a non-sputterable conductive material such as zirconium. An equally preferred material is substantially pure magnesium oxide (MgO). MgO is a natural insulator and therefore does not require the above-mentioned oxidation step. MgO is believed to have superior transparency in the visible and ultraviolet spectrums (0.22 to 8.0μm region) as compared to zirconium oxide; however, $ZrO_2$ may be a more durable material. See Roessler and Huffman, Handbook Of Optical Constants Of Solids II, pp. 926, 932, and 942, Academic Press (1992). Nevertheless, MgO is only equally preferred to zirconium because its presence precludes d.c. operation, unlike zirconium which can be oxidized if desired.

Once layers 12*a*, 12*b*, 12*c* have been deposited, they are masked and etched in conventional fashion to form a set of conductors 12, preferably parallel and linear, spaced apart from one another with surface 14*a* of substrate 14 exposed therebetween. If a hollow cathode structure is desired, the holes 26 may be formed in the same etch step done to form conductors 12, provided that a suitable mask is used. To protect the walls of holes 26 of the hollow cathodes from sputtering, they may be lined, by coating or a selective deposition step performed after the etch, with the material of layer 12*c*.

The etch may be a plasma or chemical etch process. As illustrated in FIG. 4, conductors 12 extend in the y-direction into the plane of the diagram. The width of conductors 12 in the x-direction (and the width of the conductors 16 in the y-direction in FIG. 5) bear a direct relation to the area of crosspoints 18. Because of the conflicting design criteria relating to brightness and resolution discussed above, an engineer must design a mask for etching conductors 12 (and 16) which strikes a balance in accordance with application criteria.

After the first set of conductors 12 are formed, a sacrificial spacer layer 28 is deposited so as to enwrap conductors 12. Layer 28 is selectively deposited or removed to form the structure shown in FIG. 4. The type of material used for spacer 28 is advantageously chosen to be a material etchable by means which minimally effect conductive layers 12 and 16, and is preferably copper.

Referring now to FIG. 5, a second set of conductors 16 is formed by first depositing conductive material over substantially all of surface 14*a* and the enwrapped conductors 12, and then etching the conductive material to form ribbons of conductors 16, by conventional plasma or chemical etch techniques.

Like conductors 12, conductors 16 preferably comprise several layers, the first and second layers may be identical to those of conductors 12. Thus, the first layer 16*a* is preferably either a sheet of zirconium approximately 2500 angstroms thick or MgO 2000 angstroms thick deposited on surface 14*a* and spacer layer 28, to ensure bonding to substrate 14; the second layer 16*b* is preferably a one micron sheet of nickel to provide a solderable and electroformable base. A relatively thick (ten microns) layer 16*c* of nonoxidizable and solderable, and preferably electroformable, conductive material such as nickel or gold may be electroformed upon the base layer 16*b* in the form of conductive ribbons. Layer 16*c* has a thickness chosen to withstand subsequent etching steps. Prior to electroforming, a patterned and developed positive photosensitive resist layer (not shown) would be applied to base layer 16*b* to define a pattern for the electroforming process; electroforming occurring only on the exposed areas. The resist and base layers 16*b* and perhaps some of bonding layer 16*a* are etched away in conventional manner, leaving behind a second set of conductors 16, spaced from one another in the y-direction with alternating regions of sacrificial layer 28 and surface 14*a* exposed therebetween (not shown).

The second set of conductors 16 must cross over conductors 12 to establish an array of crosspoints 18. The two sets 12 and 16 are separated by the height of sacrificial layer 28, as taken in a direction normal to surface 14*a*.

After conductors 16 are formed, sacrificial spacer layer 28 is selectively etched away in conventional manner by means which minimally effect conductive layers 12 and 16. Where layer 28 is chosen to be copper, a ferric nitrate chemical etch will selectively etch layer 28 from the enwrapped conductors 12. This selective etch forms an airbridge structure at each of the crosspoint regions 18 by removing layer 28 from between conductors 12 and 16 and exposes conductors 12 at all other locations. X-directed conductors 16 are supported above substrate surface 14*a* by post-like extensions extending substantially normal to surface 14*a* on either side of y-directed conductors 12. The result of this etch forms the structure of FIG. 2. The crosspoint regions 18 define an array of spaces or air gaps 20 between conductors 12 and 16, of a height equal to the thickness of sacrificial layer 28, as illustrated in FIG. 3. That portion of each of conductors 12 and 16 located at a given crosspoint 18 forms the electrode to which a voltage can be applied to induce light emissive gas discharge. Of course, the airbridge may contain air or any other gas sealed below capping layer 22. Alternatively, the airbridge may contain an electroluminescent material.

At this stage of processing, layers 12*c*and 16*a*, if metal, may be oxidized for a.c. operation to form symmetric and facing, spaced insulating layers. The insulators protect crosspoints 18 from short circuiting and capacitively couple the electrodes. In the preferred embodiment and as seen in FIG. 3, the zirconium layers 12*c*and 16*a* are oxidized in an oxygen-bearing furnace for five to eight hours at 350° C. to form a zirconium oxide layer 2000 angstroms thick. The starting material for this oxide should be about 1000 angstroms thick; the net effect of the oxidation resulting in a negligible 2000 angstrom encroachment upon space 20. Of course, the high temperature oxidation step is omitted if the panel is to be used for d.c. operation, or where layers 12*c*and 16*a* are a naturally insulating material such as MgO. Avoidance of this final high-temperature step eliminates a source of panel distortion and misregistry, as understood by those skilled in the art.

In the preferred embodiment of FIG. 3, space 20 may contain air at substantially atmospheric pressure which undergoes light emissive discharge at the crosspoint 18 of conductors 12 and 16 when a suitable voltage is applied across space 20. In this case, space 20 should be between ten and twenty-five microns in height and is preferably thirteen microns to ensure gas discharge at or near the Paschen minimum firing voltage at that pressure. At one atmosphere, 763 mm Hg, and a thirteen micron separation of electrodes, the pd product is 0.99 mm Hg cm which is substantially near Vmin for air. A slightly greater separation of electrode plates will increase the pd product and cause a rightward shift along curve A of FIG. 1. Nevertheless, the impact on the firing voltage in such a case would be gradual, and should not effect operation of the display because the firing voltage remains virtually constant, in the several hundred volt range. This affords the advantage of ease of interfacing the panel structure with conventional microelectronic circuitry, as discussed below.

Operation at atmospheric pressure or higher affords an increase in plasma discharge speed and a corresponding increase in the sustain frequency and hence in display brightness. This follows from Paschen's Law which states that if the product of the pressure, p, and discharge gap size, d, is held constant in plasma discharges, then time-dependent processes increase in speed in proportion to the pressure. When display 10 is operated at atmospheric pressure in accordance with the present invention, the gap size, d, can be significantly reduced, for example, from the conventional approach at low pressures (partial vacuum) which requires 0.003"–0.005" (75–150 micron) or more to 0.001"–0.002" (25–50 micron) or less. Brightness can be enhanced in other ways, for example, where the operative gas is air, hydrocarbons may be added to the air and sealed under capping layer 22 to constitute a "white-light" gas, which may be filtered into the primary colors or combinations thereof at each pixel, as described below.

For a plasma display of the present invention to have 200 color picture element triads per inch, each pixel would be only approximately 0.0016" (41 micron) wide. A "white-pixel" or "triad" is a group of three picture elements, each of which controllably generates a different primary color (red, green, or blue) to operate together to provide a full color spectrum. This is likely beyond the capability of silk screen processes, at least for production quantities, but may be accomplished through any standard optical lithographic technique. Importantly, the width of the pixels according to the present invention avoids the difficulties which are associated with manufacturing an array of transistors each having a 3 micron channel width, as is done with conventional active matrix flat-panel displays. Nevertheless, such a pixel density is imaginable for a fifty inch, 5000×9000 pixel display.

The close spacing of the electrodes can result in pinhole shorts. This phenomenon results when a layer of metal such as conductors 16 is deposited over a thin film of insulating material such as spacer 28 and penetrates, through tiny holes in the thin film, and makes electrical contact with whatever underlies the thin film. When the underlying material is a conductor, as are conductors 12 in the present structure, the result is a direct short, known as a "pinhole" short. Methods are known for eliminating any pinhole shorts such as those disclosed in U.S. Pat. No. 3,461,524 to Lepselter, which patent disclosure is hereby incorporated by reference. The thirteen micron electrode spacing, which advantageously allows operation of display 10 at or near the paschen minimum firing voltage of air at substantially atmospheric pressure, is sufficiently large so as to reduce the frequency of occurrences of pinhole shorts.

Close control over the size of space 20 is advantageously achieved by the single sided structure of the present invention in which a sacrificial layer 28 of controlled height is used to space conductors 12 and 16 at a predetermined tolerance. Of course, the foregoing is only a preferred manner of spacing two conductors, there being other known methods which one skilled in the field of microelectronics will recognize. To preselect the height of space 20, conductors 12 and 16 are advantageously chosen to be sufficiently rigid so that after the sacrificial spacer layer 28 is etched away, the resulting airbridge structure retains geometrical stability. The resulting space 20 between conductors 12 and 16 will, of course, act as a dielectric.

As an optional yet useful feature, a bonding tab 29 may be formed along at least one margin of conductors 12 and 16 for electrically connecting display 10 to external circuitry.

For higher brightness, a phosphorescent screen 24 may be deposited on the substrate below conductors 12 (see FIG. 3). The phosphor screen 24 absorbs ultraviolet photons which illuminate screen 24 for a time period continuing after the radiation has stopped. This is particularly preferred for flat-panel plasma lamps, as used for backlighting an LCD display. Alternatively, a phosphorescent substance may be deposited on and between conductors 12 and 16 of an already formed display 10 by chemical vapor techniques. In this way, the upper set of conductors, conductors 16, serve as a partial mask to the deposition of the phosphor which results in discontinuities in the phosphor coating. These discontinuities are advantageous because they prevent radiated light from one pixel "bleeding" or "crawling" through the phosphor screen toward an adjacent pixel.

While the highly reflective "airbridges" formed by conductors 16 contribute to the brightness of display 10 regardless of the presence of screen 24, a phosphor layer 24'may be formed on conductors 16 themselves, on top of transparent layer **16*a*** (see FIG. 3*a*). In this alternative embodiment, the white phosphor is disposed just behind the plasma gas and serves as an extremely efficient source of radiant light, even after the plasma glow has extinguished.

The entire structure except for the bonding tabs 29 may be capped by a capping layer 22 to seal out moisture and foreign particles. The capping layer 22 may be connected to substrate 14 by conventional means, as by fasteners, glue or heat treatment. Preferably, capping layer 22 is hermetically sealed to substrate 14 to prevent ambient humidity from condensing on conductors 12,16 and to keep the gas which generates ultraviolet light from escaping. In a preferred embodiment, air at atmospheric pressure is housed under the capping layer and in the spaces 20 at each crosspoint 18 of the crossed conductors 12 and 16. This establishes an equilibrium of pressure inside and outside of the capped panel. Unlike displays that are brought to a partial vacuum, there is no gas pressure exerted on the structure and no risk of implosion. This permits the manufacture of relatively large structures using low cost materials including plastic.

Figure 1:
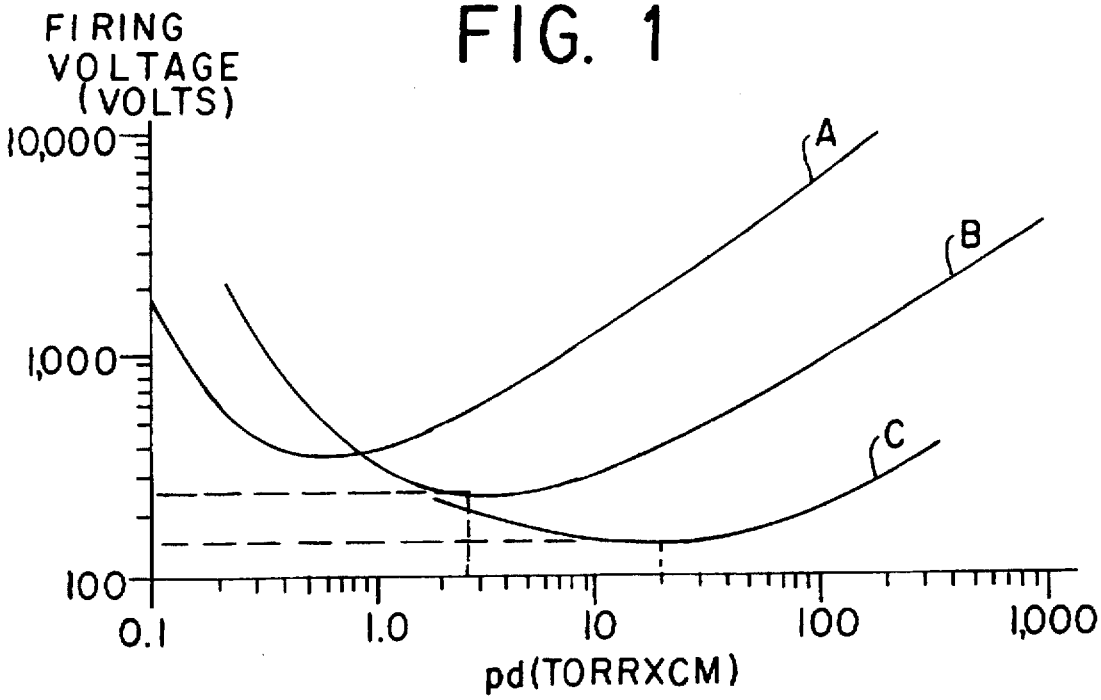
FIG. 1 is a diagram for explaining Paschen's law.

Alternatively, capping layer 22 may seal a gas at a pressure greater than atmospheric pressure. This is advantageous where a gas other than air, e.g., Neon or Neon plus 0.1% Argon, is used. In FIG. 1, the Paschen minimum firing voltage occurs at a comparably higher pd product value for curves B and C than for curve A. One skilled in the art will readily appreciate that if a predetermined distance between conductors is to remain constant for some gases other than air, such as those depicted in FIG. 1, the particular gas being used in display 10 may be sealed at a superatmospheric pressure which corresponds to a minimum firing voltage for that gas, in accordance with the Paschen curve pd product for that gas. It is generally undesirable to increase the gap size, d, because the close spacing of the conductors 12,16 provides high resolution and efficiency. Accordingly, it is preferred to increase the pressure of the gas contained in space 20 to atmospheric or superatmospheric that is above atmospheric pressure levels.

When superatmospheric pressures are used, capping layer 22 is advantageously bonded to conductive layer 16*c*, in addition to substrate surface 14*a* to prevent the capping layer from bowing away from substrate 14 due to the forces exerted on the capping layer by the gas pressure. Bonding 21 may occur at the top of each airbridge, above each crosspoint 18, and elsewhere (see FIG. 3*a*).

Preferably, capping layer 22 is of a dark or black material to provide a contrasting background for viewing display 10 through transparent substrate 14. Capping layer 22 may include a metallic layer formed so as to reflect rearward directed light forward again, through substrate 14. The use of a metallic layer also facilitates the efficient release of any heat generated within the structure. Conversely, display 10 may be viewed through a suitably transparent capping layer 22 where the substrate 14 is opaque.

In a second embodiment of the present invention, illustrated in FIG. 6, a large flat-panel display 30 is formed on one side of a transparent panel 32. Panel 32 is preferably made of a rigid transparent material such as glass, glass fiber, or high-temperature plastic. Panel 32 has a set of rectangular slots 34 of predetermined depth 36 formed on one side. Slots 34 house a first set of wires 38 having a cross-section preferably chosen to conform to the shape of slots 34. Wires 38 are held taut by conventional means, preferably at their opposite ends. Across the top of slots 34 are a second set of wires 40, disposed at an angle relative to the first set of wires 38 to form an array of crosspoints 42. Depth 36 is selected so that when wires 38 are disposed in slots 34 and wires 40 are stretched thereacross, the facing surfaces of wires 38 and 40 are approximately thirteen microns apart so that a gas at least at substantially atmospheric pressure may undergo light emissive discharge at or near its Paschen minimum voltage. Advantageously, wires 38 and 40 are coated with an insulating layer to capacitively couple the wires for a.c. operation, e.g., wires 38 and 40 are comprise conventionally pre-coated wire. The display structure 30 may be capped by a capping layer 44 to keep out dust and other foreign particles. Because display 30 operates at least at substantially atmospheric pressure, there are no significant implosive forces exerted on the structure. This permits the use of relatively inexpensive materials without mechanical braces and without concern of implosion.

FIG. 7 illustrates a third embodiment of the present invention which may be advantageously constructed for color operation by providing an airbridge 50 which spans three picture elements, one provided for each of the primary colors (red, green, and blue). The following description contemplates a.c. operation of the display panel. If d.c. operation were desired, certain of the layers described below, for example, conductors 12*a*', would be replaced with those discussed in connection with FIGS. 2 and 3. As shown, a conductive material 12*a* ', preferably a layer of indium tin oxide, is patterned into stripes onto substrate 14. The three stripes shown in FIG. 7 constitute a single whitepixel or color triad. They may, for example, occupy a single row and three columns of a larger array extending in the x- and y-directions. The substrate is then coated (e.g., by an alcohol slurry), patterned (e.g., with a photoresist) and etched in conventional manner to stack a red 52, a green 54, and a blue 56 phosphor stripe upon conductive stripes 12*a*'. Each of layers 12*a*' and 52, 54, 56 are on the order of one micron in thickness, although layers 52, 54, 56 may be up to 2 microns in thickness. While it has been described that layers 12*a* ' be deposited prior to the phosphor layers 52, 54, 56, the method is not so limited. The layers 52, 54, 56 can be deposited and patterned prior to forming conductors 12*a*', as would be appreciated by those skilled in the art.

An insulating layer 58, preferably magnesium oxide, is deposited everywhere, for example by spray or evaporation, followed by a sacrificial layer 28 (not shown), preferably made of copper, to space a second set of conductors which are deposited in a subsequent step, described below. The sacrificial layer ultimately establishes a space or air gap 60 over each picture element once it has been etched away. Optionally, sacrificial layer 58 may be planarized prior to further processing. Next, the sacrificial layer 28 is coated with an insulating layer 62, preferably MgO and preferably in the same manner as insulating layer 58.

To form the conductors 16 and airbridges 50, an array of holes 64 is etched through insulating layers 62, 58 and sacrificial layer 58 down to substrate 14, e.g., by a photolithographic process. As shown, holes 64, preferably 0.002"or 50 micron wide, are etched between each triad of pixels. This provides a reduction by a factor of three of the supporting columns necessary in the panel construction of this embodiment. A plating base, e.g., nickel which may be on the order of 2000 Å, is then deposited everywhere (not shown). The top surface 14*a* of the substrate 14 is then patterned so that a thick conductive layer to constitute conductors 16 and airbridges 50, preferably nickel, can be electroformed onto the plating base. Electroforming continues until columns 66 fill holes 64 and provide sufficient structural support for airbridges 50. Because the stiffness of each airbridge 50, which is like a beam, varies with the cube of its thickness, the electroforming should continue until columns 66 support the span of each airbridge 50 in accordance with this relationship, as appreciated by those skilled in the art. Of course, the particular span of each airbridge 50 in any panel 70 will vary with the thickness of conductors 12*a*' and the desired resolution of the panel. Alternatively, the columns can be electroformed prior to electroforming the airbridge by using a suitable mask for each electroforming step. In either case, airbridges 50 preferably have a thickness of at least eleven microns, and more preferably have a thickness which is adequate to support the beams. The upper limit on the thickness of airbridges 50 is determined by other factors such as resolution and the thickness of the resist mask. For example, if the electroformed material is applied to a thickness far beyond the top of the resist mask, the material will mushroom thereover and spread laterally, toward an adjacent row of pixels and resolution would be adversely impacted.

Once airbridges 50 have been formed, the plating base is removed, e.g., by a plasma etch, so that the panel is not shorted out by the plating base. Finally, the sacrificial layer is etched away to leave spaces 60 in which a plasma glow will occur, as in the embodiment of FIGS. 2 and 3. While the glow can freely illuminate regions 68 as well (as indicated in phantom to illustrate an artificial spatial separation), the path length between conductors 12*a*' and each airbridge 50 is not at a pd minimum in this region and so plasma discharge will not originate in region 68. The columns 66 will also prevent glow from one triad from extending into an adjacent triad.

The panel 70 can advantageously be formed without any process steps at an elevated temperature. This provides a degree of dimensional stability that might not otherwise be attainable by alternative processes which is perceived to be an additional advantage of panel 70.

FIG. 8 shows another embodiment which utilizes color filters 72, 74, 76 in combination with a white phosphor 78 to provide a display panel 80. The method of making display panel 80 is the same as that described above for panel 70 of FIG. 7, except in two respects. First, color filters in red 72, green 74 and blue 76 are patterned into stripes (instead of color phosphors 52, 54, 56) to form a white-pixel or triad. The filters 72, 74, 76 may have a thickness of approximately one micron. Also, the conductor layer 12a' may be deposited and patterned on top of or below the color filters.

Second, a layer 78 of white phosphor is deposited on the second insulating layer 62 prior to etching holes 64. Advantageously, white phosphor layer 78 us formed with a grain structure adapted to prevent lateral transmission through or the trapping of light within the layer 78. Once holes 64 are etched, columns 66 can be deposited and electrically connected to conductors 16 and airbridges 50. It is to be understood that each airbridge 50 is a part of an x-directed (as depicted) or y-directed conductor which, in conjunction with one of the crossingly disposed conductors 12a', provides a crosspoint 18 for glow discharge in space 60 when a suitable voltage is applied.

In operation the white phosphor 78 functions to shift the wavelength of any ultraviolet discharge in a respective space 60 to white light. The ultraviolet light generated by the plasma in space 60 travels into the white phosphor 78 (and elsewhere) and then back out through substrate 14 by reflection from the airbridge 50 that abuts the white phosphor. This light is viewed through a respective one or more of color filters 72, 74, 76, to controllably provide a full color output spectrum. While the operation of panel 80 is explained generally in connection with FIG. 10, it is to be understood that if a suitable voltage is applied to, for example, the conductors 12a' associated with red 72 and green 74 color filters and to one of conductors 16, then panel 80 would produce yellow light at the crosspoint 18 of that pixel triad, in accordance with the principle of superposition of primary colors. See Hecht, *Optics*, 2d Ed. p. 115.

It is also to be understood that the layout of pixels described in connection with this and other embodiments of the display panel are exemplary, there being other layouts and configurations which are to be considered within the scope of the invention.

In FIG. 9, there is seen a modification of the panel structure of FIG. 8 wherein the substrate 14' has been provided with a slotted surface 14a'. Although this figure is unscaled, it better approximates the relative horizontal and vertical dimensions of the flat-panel display than that of FIG. 8; accordingly only one picture element of a white-pixel or triad is shown. The slotted surface 14a' has a plurality of slots 82, each of which may preferably be approximately two microns deep. The slots 82 may, for example, be formed by a liquid honing process or the like. Liquid honing is a process wherein a water jet carrying an abrasive slurry is oriented to impinge upon a target, such as substrate 14, to abrade an unmasked portion of the target, for example, to form slots 82. The slots 82 may house color filters 72, 74, 76 and conductors 12a' so as to provide a planar structure when the filters and conductors are chosen to have a stacked layer thickness substantially equal to the depth of the slots.

Advantageously, the sidewalls of slots 82 are metalized, preferably with nickel, as may be accomplished by the process of compound sputtering. See U.S. Pat. No. 4,343,082 to Lepselter et al. The metalized sidewalls 84 function as self-aligned transmission lines to convey signals or pulses, such as voltage signals, along the elongated dimension of conductors 12a'. When metalized sidewalls 84 are chosen to be nickel and conductors 12a' are indium tin oxide, the sidewalls provide a low resistance path for signal flow as compared to a one micron thick layer of ITO, which has a sheet resistance of approximately from 10 to 20 ohms per square. As a result, the panel construction 90 can operate at a relatively high frequency with associated high speed circuitry, such as 100 MHz or more.

The sidewalls 84 may be formed on substrate 14' by sputter depositing a metal from a sputtering electrode (not shown) positioned above the substrate within a gas chamber. Preferably, sputtering electrode is made of nickel and the gas chamber is filled with argon gas. A d.c. voltage V1 with its positive terminal applied to the sputtering electrode excites a plasma at the surface of the sputtering (cathodic) electrode. Similarly, a radio-frequency voltage source V2 applied to substrate 14'through a capacitance C excites a plasma on the (anodic) substrate surface. This source conventionally has a frequency of 13.5 MHz. Ions from the excited plasma bombard the target, sputtering electrode to liberate metal ions, for example, nickel. When the sputtering electrode is positioned above substrate 14', the sputtered ions initially travel perpendicularly toward the substrate 14'; however, some of the sputtered ions collide with the ions in the plasma and cause the sputtered ions to bounce back toward the substrate surface with a non-perpendicular orientation. The voltages V1 and V2 are adjusted in conventional manner so that the net arrival rate (and hence growth rate) on the horizontal planes is zero. The substrate surface 14a' remains atomically smooth because the quartz- or glass-like surface of the substrate is not reduced by the metal ions. However, the sputtered ions which have bounced back toward the substrate surface are trapped along the sidewalls where they gather as metallized sidewalls 84 along the sidewalls of slots 82. These metalized sidewalls build into vertical sidewalls of suitable thickness, for example, the depth of slot 82 or less and function as transmission lines to convey electrical signals, as noted above. The process provides metallized sidewalls 84 which are self-aligned with the slots.

The conductors 12a' and filters 72, 74, 76 of the embodiment of FIG. 8 can be patterned and formed co-linearly within slots 82 before or after the metalized sidewalls 84 are formed. The color filters may be deposited by a silkscreen process and the conductors may be formed by a patterned deposition and etch. It is not important to the invention which of the conductors and the color filters are deposited first. Also, metallized sidewalls 84 can serve as the first set of elongated conductors without providing conductors 12a' at all; however, because conductors 12a' flatten the plasma by providing a uniform capacitor plate opposite conductors 16, their presence is preferred. The panel structure 90 of FIG. 9 is otherwise completed in the same manner as described in connection with panel 80 of FIG. 8.

As with panel 70, panels 80 and 90 of FIGS. 8 and 9 can be formed without any process steps at an elevated temperature.

With the foregoing structures in mind, operation of the flat-panel display may now be described with reference to FIG. 10.

FIG. 10 illustrates a video display system 80 incorporating display 10, 30 of the present invention. A video signal that is to be displayed is preferably stored digitally, frame by frame in a digital memory chip. System 80 includes a video signal processing means 82 which receives analogue or digital video signals 84 and provides signals, in digital format, to buffer means 86 as digitalized signals 88. Buffer means 86 is a temporary storage area that stores at least one video frame of digitalized signals 88. Buffer means 86 preferably comprises a conventional random access memory (RAM) chip or variety thereof (SRAM, DRAM, etc.). Each video frame is preferably converted into a digitalized array of pixels, advantageously addressable by row and column coordinates corresponding to like coordinates of the original video signal. Video signal processing means 82 converts signals 84 into an addressable array of pixels and assigns intensity information to each pixel address. Buffer means 86 stores the addressable digitalized signals 88, in conventional manner, by row and column coordinates. Digitalized signals 88 may comprise status, intensity, and color level information.

A memory means 90 may receive one video frame of digitalized signals 88 from buffer means 86 so that the next video frame 88' may be loaded into buffer means 86. Memory means 90 may also be a conventional RAM chip.

For grey-scale black and white operation, along with the information indicating whether a pixel is "on" or "off", there is associated with each pixel address least information relating to the brightness of the pixel. This information may be stored in the form of one or more bytes of digital memory of buffer means 86 (and memory means 90). Each byte of memory used can store 94 different brightness levels for a given pixel. For color operation, the same brightness information is determined for each of the red, green and blue pixels that comprise a white-pixel or triad, as appreciated by those skilled in the art.

In operation, the pixels of display 10, 30 are addressed or scanned sequentially, a row at a time, by interface and addressing circuit 92 ("IAC"). IAC 92 receives digitalized signals 88 from memory means 90 and high voltage from high voltage supply 94 and selectively applies a high voltage signal at crosspoints 18, 42 in accordance with the status and intensity information associated with each pixel of a given video frame 88. Of course, memory means 90 may be internal to IAC 92, along with buffer means 86 and video signal processing means 82 depending on the level of integration of circuitry, e.g. very large scale or ultra-large scale integration. IAC 92 scans display 10, 30 at least 90 times per second so that a human eye may perceive a steady video image corresponding to video signal 84.

If a given pixel is in the "off" state, as indicated by the status information received by IAC 92 from memory means 90, then high voltage supply 94 will not be applied to the crosspoint 18, 42 presently being scanned and no light will radiate from that location on the panel. However, if the pixel is in the "on" state, also as indicated by the status information received from IAC 92, then high voltage supply 94 will be applied to the crosspoint 18, 42 presently being scanned which will induce gas discharge and illuminate that crosspoint of the display for the present scan cycle.

To perceive a grey scale, that is, shades of intensities on display 10, 30, IAC 92 scans display 10, 30 at a multiple of the requisite 90 times per second, preferably in the megahertz range. The stored intensity information for each pixel may be decremented or modified each time display 10, 30 is scanned until the intensity information corresponds to a preselected value at which time high voltage supply 94 will no longer be applied upon subsequent scanning of the same video frame 88. Thus, assuming display 10, 30 is scanned thirty two times over the course of one sixtieth of a second, one pixel having an intensity of "eight" may be on one fourth of one sixtieth of a second whereas another pixel having an intensity of "sixteen" may be on for one half the scan time. Because the eye is not sensitive to such rapid flashes, the result is a range of brightness limited only by the range of stored brightness levels and processor speed. Because display 10, 30 is operated at relatively high pressure, the electrons in the plasma have relatively short diffusion lengths and recombine with ions to extinguish the discharge rapidly. This advantageously enables fast processing and a wider grey or "Z" scale of operation.

The relative intensity of red, green, or blue light from light from any given white-pixel or triad is similarly controlled.

It should be realized that display 10 may be viewed from the front or the rear, either through substrate 14, when substrate 14 is transparent, or through capping layer 22. Additionally, display 10 may be viewed through both sides, but not at the same time, by including means for swapping the column addresses, left to right, of the digitalized signal so that the image on the reverse side of the panel appears in the same spacial location as the original video signal. Several transparent displays 10 can be stacked to display a three dimensional image such as required in computer aided design, nuclear magnetic resonance, and other specialized applications.

One skilled in the art will recognize that conductors 12 and 16 need not be linear strips of conductive material as shown, but may be crossed sinusoids, square or triangular wave patterns or the like, limited only by the requirement that an array of crosspoints 18 be formed for viewing the video signal.

From the foregoing description, it will be clear that the present invention may be embodied in other specific forms without departing from the spirit or essential characteristics thereof. Thus, for example, while the examples discussed above have described a directly viewable display panel, the panel could likewise project an image onto a half-silvered mirror to form a "heads up" display. Also, the flat-panel structure of the present invention has equal advantage and utility when used to put a latent image onto a transfer plate for photocopying or printing applications. The presently disclosed embodiments are therefore to be considered in all respects as illustrative and not restrictive, the scope of the invention being indicated by the appended claims, and not limited to the foregoing description.

I claim:

1. A flat-panel plasma display structure, comprising:

a substrate having a substantially planar surface;

a first set of conductors and a second set of conductors both being supported on said planar surface;

said second set of conductors having a multiplicity of first portions in contact with said planar surface and a multiplicity of second portions crossing over said first set of conductors at an angle thereto and at a preselected distance therefrom, said preselected distance defining a discharge space between said first and second sets of conductors at the crosspoints; and a gas in said discharge space, said gas being at substantially atmospheric pressure or above and having a pressure such that the flat-panel plasma display structure is substantially free of implosive forces.

2. The flat-panel plasma display structure as in claim 1, wherein said preselected distance is chosen so that light emissive discharge initiates at a particular crosspoint only when a voltage greater than or equal to the Paschen minimum firing voltage is applied across said discharge space at said particular crosspoint.

3. The flat-panel plasma display structure as in claim 1, wherein said gas is air.

4. The flat-panel plasma display structure as in claim 1, further comprising a phosphor coating disposed on said substrate.

5. The flat-panel plasma display structure as in claim 1, further comprising a plurality of phosphor strips, each of said phosphor strips being in abutting relation to one of said first and second sets.

6. The flat-panel plasma display structure as in claim 1, wherein at least one of said first and second sets includes an aperture at each of said crosspoints whereby any light emissive discharge is be observed therethrough.

7. The flat-panel plasma display structure as in claim 1, wherein at least a portion of one of said first and second sets includes an insulating layer.

8. The flat-panel plasma display structure as in claim 1, wherein at least a portion of each of said first and second sets includes an insulating layer.

9. The flat-panel plasma display structure as in claim 8, wherein each of said first and second sets has a surface and wherein the surface of said first set faces the surface of said second set, said insulating layer being disposed on the facing surfaces at least at each of the crosspoints.

10. The flat-panel plasma display structure as in claim 1, further comprising a capping means to hermetically seal said first and second sets.

11. The flat-panel plasma display structure as in claim 10, wherein said capping means is bonded to said second set.

12. The flat-panel plasma display structure as in claim 10, further comprising a red, a green and a blue filter disposed in abutting relation to one of said first and second sets.

13. The flat-panel plasma display structure as in claim 10, further comprising a red, a green and a blue phosphor disposed in abutting relation to one of said first and second sets.

14. The flat-panel plasma display as in claim 1, wherein each of said crosspoints is addressable by the particular conductors which cross over to define that crosspoint, further comprising:

video signal processing means for converting the video signal into an array of digitalized picture elements, said processing means imparting at least address and intensity information to said array of digitalized picture elements;

memory means for storing said array of digitalized picture elements;

addressing means for accessing said memory means; and interface means for selectively applying a first voltage to said addressable crosspoints in accordance with said address and intensity information from said accessed memory means.

15. The flat-panel plasma display as in claim 14, further comprising buffer means connected between said video signal processing means and said memory means for storing one array of digitalized picture elements while said memory means stores a previous array of digitalized picture elements.

16. The flat-panel plasma display as in claim 14, wherein said video signal processing means includes a digital convertor to convert the video signal to a digital signal before converting the video signal into an array of digitalized picture elements.

17. The flat-panel plasma display as in claim 14, wherein said interface means selectively applies a second voltage to sustain light emissive discharge at a particular crosspoint, said second voltage being less than said first voltage.

18. A flat-panel plasma discharge lamp, comprising:

a substrate having a substantially planar surface;

a first set of conductors and a second set of conductors both being supported on said planar surface;

said second set of conductors having a multiplicity of first portions in contact with said planar surface and a multiplicity of second portions crossing over said first set of conductors at an angle thereto and at a preselected distance therefrom, said preselected distance defining a discharge space between said first and second sets of conductors at the crosspoints; and a gas in said discharge space, said gas being at substantially atmospheric pressure or above and having a pressure such that the flat-panel plasma display structure is substantially free of implosive forces.

19. The flat-panel plasma discharge lamp as in claim 18, wherein each of said crosspoints is addressable by the particular conductors which cross over to define that crosspoint, further comprising:

video signal processing means for converting the video signal into an array of digitalized picture elements, said processing means imparting at least address and intensity information to said array of digitalized picture elements;

memory means for storing said array of digitalized picture elements;

addressing means for accessing said memory means; and interface means for selectively applying a first voltage to said addressable crosspoints in accordance with said address and intensity information from said accessed memory means.

20. The flat-panel plasma discharge lamp as in claim 19, further comprising buffer means connected between said video signal processing means and said memory means for storing one array of digitalized picture elements while said memory means stores a previous array of digitalized picture elements.

21. The flat-panel plasma discharge lamp as in claim 19, wherein said video signal processing means includes a digital convertor to convert the video signal to a digital signal before converting the video signal into an array of digitalized picture elements.

22. The flat-panel plasma discharge lamp as in claim 19, wherein said interface means selectively applies a second voltage to sustain light emissive discharge at a particular crosspoint, said second voltage being less than said first voltage.

* * * * *